US009234627B2

(12) United States Patent
Cajiga et al.

(10) Patent No.: US 9,234,627 B2
(45) Date of Patent: Jan. 12, 2016

(54) SYSTEM, APPARATUS AND METHOD FOR THE COLD-WEATHER STORAGE OF GASEOUS FUEL

(76) Inventors: Jose A. Cajiga, Keybiscayne, FL (US); Arturo Cajiga Villar, Keybiscayne, FL (US); Vicente Cajiga Villar, Keybiscayne, FL (US)

( * ) Notice: Subject to any disclaimer, the term of this patent is extended or adjusted under 35 U.S.C. 154(b) by 858 days.

(21) Appl. No.: 13/135,494

(22) Filed: Jul. 8, 2011

(65) Prior Publication Data

US 2013/0008558 A1 Jan. 10, 2013

(51) Int. Cl.
*B65B 3/04* (2006.01)
*F17C 1/14* (2006.01)
(Continued)

(52) U.S. Cl.
CPC . *F17C 1/14* (2013.01); *F17C 5/007* (2013.01); *F17C 5/06* (2013.01); *F17C 7/00* (2013.01); *F17C 13/026* (2013.01); *F17C 2201/0109* (2013.01); *F17C 2201/054* (2013.01); *F17C 2203/0329* (2013.01); *F17C 2203/066* (2013.01); *F17C 2203/0617* (2013.01); *F17C 2203/0621* (2013.01); *F17C 2203/0639* (2013.01); *F17C 2205/0142* (2013.01); *F17C 2205/0149* (2013.01); *F17C 2205/0196* (2013.01); *F17C 2205/0326* (2013.01); *F17C 2205/0335* (2013.01); *F17C 2221/033* (2013.01); *F17C 2223/0123* (2013.01); *F17C 2223/036* (2013.01); *F17C 2225/0123* (2013.01); *F17C 2225/036* (2013.01); *F17C 2227/0157* (2013.01); *F17C 2227/0304* (2013.01); *F17C 2227/0341* (2013.01); *F17C 2227/0381* (2013.01); *F17C 2227/0386* (2013.01); *F17C 2227/0388* (2013.01); *F17C 2227/041* (2013.01); *F17C 2250/032* (2013.01); *F17C 2250/0439* (2013.01); *F17C 2250/0491* (2013.01);
(Continued)

(58) Field of Classification Search
CPC ..... B65B 3/04; B65B 3/00; B65D 83/00; B65D 88/00; B65D 90/02
USPC ..... 141/12, 18, 71, 82; 220/565, 567, 220/567.2; 222/1
See application file for complete search history.

(56) References Cited

U.S. PATENT DOCUMENTS 2,018,857 A * 10/1935 Kniskern ..... 62/49.1
2,351,131 A * 6/1944 Kerr ..... 431/36
(Continued)

FOREIGN PATENT DOCUMENTS

DE 20213688 11/2002
DE 20309846 9/2003

*Primary Examiner* — Jason K Niesz
*Assistant Examiner* — Andrew Schmid
(74) *Attorney, Agent, or Firm* — Grogan, Tuccillo & Vanderleeden, LLP

(57) ABSTRACT

A system for the cold-weather storage of gaseous fuels includes a gas source having an inlet pressure, a compressor having an inlet and an outlet, the inlet selectively communicating with the gas source and the outlet having a discharge pressure greater than the inlet pressure, a heat exchange apparatus having an inlet and an outlet, the inlet selectively communicating with the compressor so as to receive pressurized gas therefrom, a high-pressure storage tank having an inlet and an outlet, the inlet selectively communicating with the compressor so as to receive pressurized gas therefrom, and a valve assembly for selectively directing the pressurized gas to the heat exchange apparatus and the high-pressure storage tank in dependence upon a temperature within the storage tank.

14 Claims, 4 Drawing Sheets
(2 of 4 Drawing Sheet(s) Filed in Color)

(51) Int. Cl.

| | |
|---|---|
| ***F17C 5/00*** | (2006.01) |
| ***F17C 5/06*** | (2006.01) |
| ***F17C 7/00*** | (2006.01) |
| ***F17C 13/02*** | (2006.01) |

(52) U.S. Cl.

CPC .. *F17C 2250/0631* (2013.01); *F17C 2250/072* (2013.01); *F17C 2260/023* (2013.01); *F17C 2260/025* (2013.01); *F17C 2265/04* (2013.01); *F17C 2265/065* (2013.01); *F17C 2270/0139* (2013.01)

(56) References Cited

U.S. PATENT DOCUMENTS

| | | | | | |
|---|---|---|---|---|---|
| 2,402,355 | A | * | 6/1946 | Whaley, Jr. | 62/49.1 |
| 2,663,626 | A | * | 12/1953 | Spangler | 48/190 |
| 3,881,962 | A | * | 5/1975 | Rubinstein | 136/209 |
| 4,628,970 | A | * | 12/1986 | Vasella | 141/18 |
| 4,986,446 | A | | 1/1991 | Montgomery | |
| 5,107,906 | A | * | 4/1992 | Swenson et al. | 141/11 |
| 5,360,139 | A | * | 11/1994 | Goode | 222/40 |
| 5,373,702 | A | * | 12/1994 | Kalet et al. | 62/50.2 |
| 5,409,046 | A | * | 4/1995 | Swenson et al. | 141/11 |
| 5,699,839 | A | * | 12/1997 | Dehne | 141/248 |
| 5,771,946 | A | * | 6/1998 | Kooy et al. | 141/82 |
| 5,901,758 | A | * | 5/1999 | Hwang et al. | 141/2 |
| 5,908,141 | A | * | 6/1999 | Teel | 222/3 |
| 6,263,864 | B1 | * | 7/2001 | Kelley | 123/527 |
| 6,354,088 | B1 | * | 3/2002 | Emmer et al. | 62/50.1 |
| 6,360,793 | B1 | * | 3/2002 | Sugano et al. | 141/197 |
| 6,644,039 | B2 | * | 11/2003 | Hughes et al. | 62/49.1 |
| 6,732,769 | B2 | * | 5/2004 | Del Campo | 141/97 |
| 6,810,924 | B2 | * | 11/2004 | White | 141/82 |
| 6,834,686 | B2 | * | 12/2004 | Gray et al. | 141/4 |
| 7,290,774 | B2 | | 11/2007 | Despres | |
| 7,500,497 | B2 | * | 3/2009 | Michel et al. | 141/2 |
| 7,617,848 | B2 | * | 11/2009 | Matheoud et al. | 141/45 |
| 7,938,149 | B2 | * | 5/2011 | Handa | 141/82 |
| 8,256,449 | B2 | * | 9/2012 | Handa | 137/338 |
| 2002/0170297 | A1 | * | 11/2002 | Quine et al. | 62/50.2 |
| 2003/0150510 | A1 | * | 8/2003 | Cohen et al. | 141/83 |
| 2004/0182470 | A1 | * | 9/2004 | White | 141/11 |
| 2004/0221918 | A1 | * | 11/2004 | Viegas et al. | 141/231 |
| 2005/0284154 | A1 | * | 12/2005 | Peter et al. | 62/45.1 |
| 2006/0005895 | A1 | * | 1/2006 | Gram et al. | 141/104 |
| 2006/0016512 | A1 | * | 1/2006 | Takano et al. | 141/82 |
| 2006/0180236 | A1 | * | 8/2006 | Hoke, Jr. | 141/94 |
| 2008/0209916 | A1 | * | 9/2008 | White | 62/48.1 |
| 2008/0289591 | A1 | * | 11/2008 | Tessier et al. | 123/41.31 |
| 2009/0205745 | A1 | * | 8/2009 | Farese et al. | 141/12 |
| 2009/0314382 | A1 | | 12/2009 | Capizzo | |
| 2012/0000574 | A1 | * | 1/2012 | Nishiumi | 141/94 |
| 2012/0036888 | A1 | * | 2/2012 | Vandor | 62/613 |
| 2012/0125480 | A1 | * | 5/2012 | Inagi et al. | 141/4 |
| 2012/0318406 | A1 | * | 12/2012 | Cajiga et al. | 141/98 |
| 2013/0008558 | A1 | * | 1/2013 | Cajiga et al. | 141/12 |
| 2013/0175201 | A1 | * | 7/2013 | Cajiga et al. | 208/46 |

* cited by examiner

SYSTEM, APPARATUS AND METHOD FOR THE COLD-WEATHER STORAGE OF GASEOUS FUEL

FIELD OF THE INVENTION

The present invention relates generally to fuel storage and distribution and, more particularly, to a system, apparatus and method for the cold-weather storage and distribution of gaseous fuels.

BACKGROUND OF THE INVENTION

As gasoline prices have soared and concerns over harmful emissions have mounted in recent years, vehicles that run on alternative fuel sources are becoming increasingly important. For example, the use of compressed natural gas ("CNG") as an alternative fuel for motor vehicles is becoming increasingly popular throughout the world because it is relatively inexpensive, burns cleanly, is relatively abundant and is adaptable to existing technologies.

Natural-gas vehicles use the same basic principles as gasoline-powered vehicles. In other words, the fuel (natural gas) is mixed with air in the cylinder of, e.g., a four-stroke engine, and then ignited by a spark plug to move a piston up and down. Although there are some differences between natural gas and gasoline in terms of flammability and ignition temperatures, natural-gas vehicles themselves operate on the same fundamental concepts as gasoline-powered vehicles. Accordingly, existing gasoline-powered vehicles may be converted to run on CNG, thereby easing the transition between gasoline and CNG in markets where gasoline-powered vehicles are dominant. In addition, an increasing number of vehicles worldwide are being originally manufactured to run on CNG.

Advantageously, CNG-fueled vehicles have lower maintenance costs when compared with other fuel-powered vehicles. In addition, CNG emits significantly fewer pollutants such as carbon dioxide, hydrocarbons, carbon monoxide, nitrogen oxides, sulfur oxides and particulate matter compared to petrol.

Despite the advantages of compressed natural gas as a motive fuel, the use of natural gas vehicles faces several logistical concerns, including fuel storage and infrastructure available for delivery and distribution at fueling stations. Natural gas suitable for vehicle use is customarily stored in small capacity tank, at 3,600 psi at 70° F., and is distributed from storage tanks to an on-vehicle receiving tank by "cascade filling." Cascade filling is accomplished by starting out with the storage tank at a higher pressure than the receiving tank and then allowing this pressure to force the gas (or liquid) into the receiving tank. In so doing, natural gas is transferred, and the pressure in the storage tank drops to the point where the pressures of the two tanks become equal and nothing more is transferred.

The storage and distribution of CNG is severely affected, however, at low temperatures, and particularly when the temperature drops below 40° F. At low temperatures, the pressure in the storage tank drops, thereby resulting in less of a difference in pressure between the receiving tank and the storage tank, ultimately resulting in inefficiencies in gaseous fuel transfer (i.e., less gaseous fuel being transferred to the receiving tank on board the compatible vehicle, and longer filling times).

Moreover, the storage of CNG in large capacity tanks at high pressures is also problematic. In particular, storing CNG in tanks at 3,000-3,600 psi requires that the tank's walls be cast from thick steel or other suitable metal in order to withstand the enormous stresses caused by the compressed gas. As will be readily appreciated, large capacity CNG storage tanks would therefore be undesirably heavy and inefficient and expensive to manufacture and transport. As a result, transportation and storage of CNG is customarily effectuated by using numerous smaller, tube-shaped cylinders, which themselves are extremely heavy.

With the forgoing problems and concerns in mind, it is the general object of the present invention to provide a system and method for the cold-weather storage and distribution of gaseous fuels, which utilizes large capacity tanks that are insulative and have a reduced weight.

SUMMARY OF THE INVENTION

With the forgoing concerns and needs in mind, it is a general object of the present invention to provide a system and method for the cold-weather storage and distribution of gaseous fuels.

It is another object of the present invention to provide a system and method for the cold-weather storage and distribution of compressed natural gas.

It is another object of the present invention to provide a system and method for the cold-weather storage and distribution of gaseous fuels that compresses the fuels to a predetermined storage pressure.

It is another object of the present invention to provide a system and method for the cold-weather storage and distribution of gaseous fuels that maintains the gaseous fuel at a desired storage temperature.

It is another object of the present invention to provide a system and method for the cold-weather storage and distribution of gaseous fuels having a tank that has a greater storage capacity and is lighter than existing storage tanks.

These and other objectives of the present invention, and their preferred embodiments, shall become clear by consideration of the specification, claims and drawings taken as a whole.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The present invention will be better understood from reading the following description of non-limiting embodiments, with reference to the attached drawings, wherein below.

DETAILED DESCRIPTION OF THE PREFERRED EMBODIMENT

Figure 1:
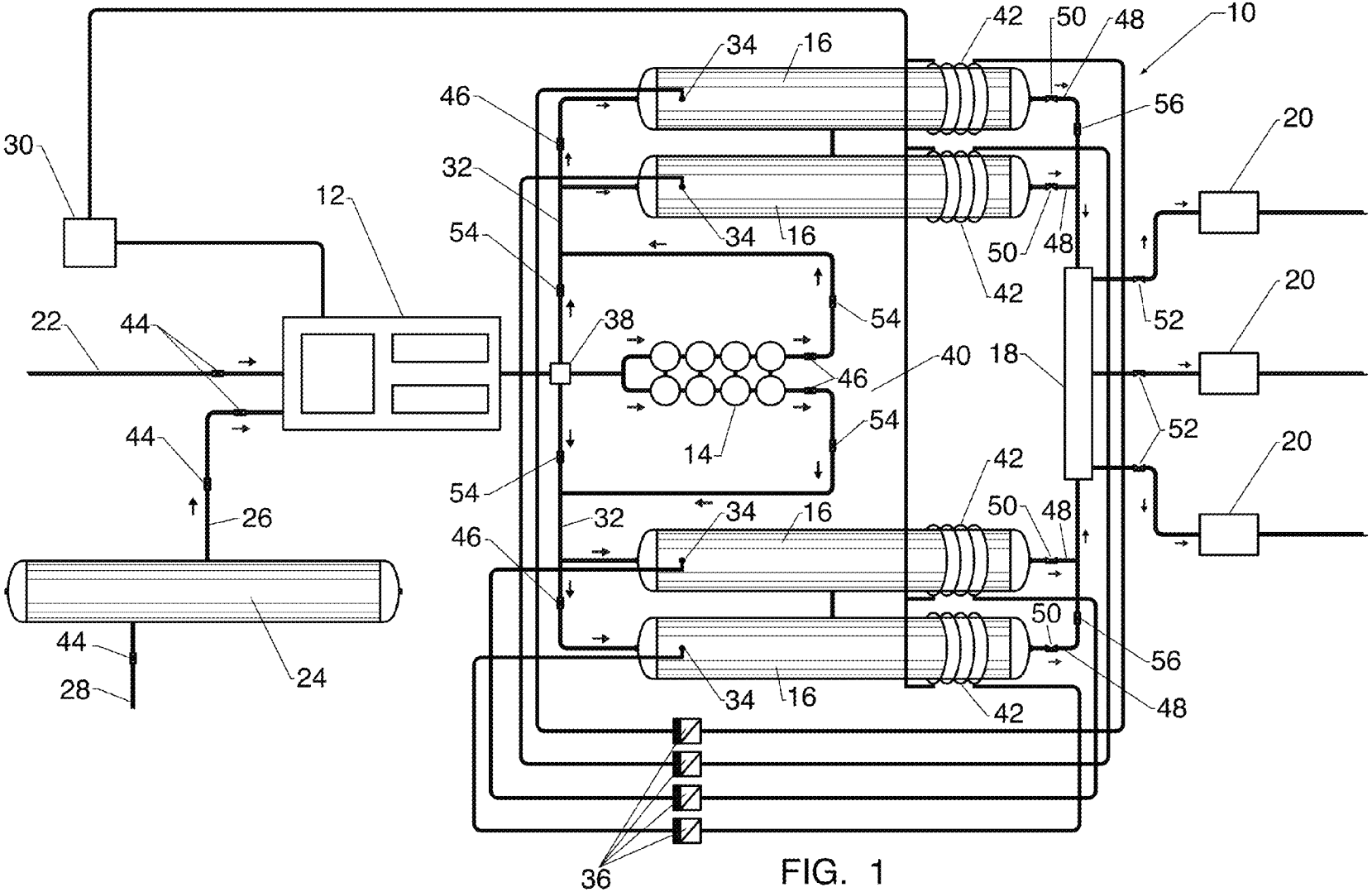
FIG. 1 is a schematic view of a system for the cold-weather storage of gaseous fuels in accordance with one embodiment of the present invention.

An embodiment of the system of the present invention is indicated in general at 10 in FIG. 1. As shown therein, the system includes a slow fill compressor 12, a heat exchange apparatus 14, a plurality of gaseous fuel storage tanks 16, a manifold 18 and a plurality of fast fill dispensers 20.

As described in greater detail below, gaseous fuel, e.g., natural gas, is transferred from a low-pressure source to the slow fill compressor 12. As used herein, "low pressure" is intended to mean the pressure at which the particular gas is originally introduced to the system 10. In the preferred embodiment, the low-pressure source is a low pressure gas line 22 extending from a gas main, wherein the low pressure is the line pressure of the gas main. Alternatively, however, the low-pressure source may be a low-pressure gas tank 24 that is fluidly connected to the slow fill compressor 12 by a pipeline 26. In this embodiment, the natural gas may be delivered by a tanker truck, unloaded from the truck via a loading pipeline 28, and stored in the low-pressure gas tank 24 for use on demand. In any event, the low pressure gas line 22 and/or the low pressure gas tank 24 provide an on-demand supply of gaseous fuel for compression, storage and distribution by the system 10, as described in detail hereinafter.

Returning to FIG. 1, the slow fill compressor 12 includes an inlet and an outlet and may be of the type known in the art, but in any event has a relatively low flow rate. The slow fill compressor 12 is in electrical communication with a power supply 30 for powering the compressor 12. The power supply 30 may be an electrical outlet hooked up to the power grid. In alternative embodiments, the power supply 30 may be a generator, one or more batteries, or an alternative power generation device such as a solar panel or the like, without departing from the broader aspects of the present invention. In operation, the slow fill 12 compressor intakes and compresses the low-pressure gaseous fuel from the low-pressure source 22 or 24. The compressed gas is then routed through a direct fill line 32 to the storage tanks 16, from which it can then be dispensed to compatible vehicles through one or more fast fill dispensers 20.

As alluded to above, gaseous fuel storage and distribution and, in particular CNG storage and distribution are greatly affected when temperatures drop below 40° F. It is therefore crucial for efficient storage and distribution that the CNG in the storage tanks is maintained at roughly 70° F. at 3,600 psi, as is standard in the industry. Importantly, the system 10 further includes a means of maintaining the temperature of the gaseous fuel in the storage tanks at a desired level, even when ambient air temperature drops, as discussed below.

In cold weather, especially below 40° F., the temperature of the gaseous fuel in the storage tanks begins to drop, as does the pressure within the storage tanks. As gaseous fuel stored in the tanks 16 is distributed to compatible vehicles, the slow fill compressor 12 is actuated to intake and compress source gas to replenish the gaseous fuel and pressure in the tanks 16. As the low-pressure source gas is compressed by the slow fill compressor 12, its temperature, as well as pressure, rises. This heated, compressed gas is then routed along the direct fill pipeline 32 to the storage tanks 16 for storage. The warmer compressed gas enters the tanks 16 so as to allow the incoming, warmer compressed gas to mix with the gaseous fuel already present in the tanks 16 so as to raise its temperature to a desired and optimum point, namely, approximately 70° F.

In this manner, compression of low-pressure source gas generates heat, which is then transferred to the gaseous fuel inside the storage tanks 16 to maintain the temperature thereof. As will be readily appreciated, fuel distribution to compatible vehicles triggers an almost continuous, slow pumping and compression of source gas, thereby providing the storage tanks 16 with an almost continuous supply of heat. As a result, cost savings can be realized because stand-alone heaters do not need to be utilized to maintain the temperature of the gaseous fuel within the tanks.

As further shown in FIG. 1, each of the storage tanks 16 includes a temperature sensor 34 connected to a thermostat 36, each of which are set to maintain a desirable temperature of gaseous fuel inside each tank 16. When the desired or setpoint temperature is reached within the tanks 16, the thermostat 36 sends a signal to a solenoid valve 38 which changes the direction of the compressed gas exiting the slow fill compressor 12. In particular, a solenoid valve 38 adjacent the exit of the slow fill compressor 12 is actuated such that the compressed gas exiting the slow fill compressor 12 is not routed directly into the storage tanks 16 via the direct fill line, but is instead directed along a heat exchange loop 40 having a heat exchange apparatus 14. The heat exchange apparatus 14 effectively cools the compressed gas, i.e., heat from the gas is transferred to the heat exchange apparatus 14, before the gas is directed back to the storage tanks 16. Once cooling is effectuated, the compressed gas exits the heat exchange loop 40 and is fed into to a downstream portion of the direct fill line 32 and, ultimately, into the storage tanks 16.

In the event that the tanks 16 are full, for instance when no dispensing is occurring, no compression is taking place and thus no heat from the compression of source gas is available to maintain the temperature of the gaseous fuel inside the storage tanks 16. Accordingly, in order to maintain the temperature of the gaseous fuel in cold weather during times of little or no replenishing of the tanks (i.e., when fuel dispensing is low), the storage tanks 16 are additionally provided with an auxiliary electric heater 42 located in the main body of each of the tanks, discussed in more detail below. In the preferred embodiment, the power supply 30 that powers the slow fill compressor 12 also powers each electric heater 42, although a separate power supply may also be used without departing from the broader aspects of the present invention.

Importantly, as discussed above, the temperature sensor 34 positioned within each storage tank 16 monitors a temperature of the gaseous fuel within each tank 16. As shown in FIG. 1, each temperature sensor 34 is connected to a thermostat 36 that is set to maintain a desired temperature within each tank 16. In the preferred embodiment, the desired temperature is approximately 70° F., although the thermostat 36 can be configured to maintain any desired setpoint temperature. When the heat generated from compression of the low pressure source gas is not is not available to maintain the temperature of the gaseous fuel within the tanks 16, or when compression generated heat cannot keep up with temperature demand, the temperature sensor 34 will detect declining temperatures or a temperature below the setpoint temperature of the thermostat 36. In response, the auxiliary heater 42 will be activated by the thermostat 36 to provide auxiliary heat to each fuel tank 16 to maintain or raise the temperature inside each tank 16. Once the temperature of the gaseous fuel within the storage tanks 16 again reaches the setpoint temperature of the thermostat 36, the auxiliary electric heater 42 is automatically switched off.

Preferably, the electric heater 42 is envisioned as a "blanket" which surrounds at least a portion of the tanks 16, although other configurations and positioning of the electric heater 42 are also contemplated in the present invention.

As further shown in FIG. 1, valves 44 control the flow of low pressure gas from the loading truck into the low pressure tank 24, from the low pressure tank 24 into the slow fill compressor 12, and from the low pressure gas line 22 into the slow fill compressor 12. Other valves 46 control the flow of pressurized gas from the heat exchange apparatus 14 into the storage tanks 16. The output pipeline 48 of each storage tank 16 is also configured with a valve 50 to control the flow of compressed gaseous fuel from the tanks 16 to the manifold 18. Finally, valves 52 control the flow of gaseous fuel from the manifold 18 to each fuel dispenser 20.

Check valves 54 are positioned downstream from the solenoid valve along the direct fill line 32 and downstream the heat exchange apparatus 14 along the heat exchange loop 40. The check valves 54 desirably control the direction of flow through the heat exchange loop 40 and the direct fill line 32 toward the storage tanks 16, and prevent undesirable flow reversals that might otherwise occur due to unexpected pressure changes, leaks, equipment failures, or the like. Check valves 56 are also positioned along the output pipelines to control the direction of flow therethrough and to prevent similar flow reversals.

Importantly, the system 10 of the present invention is, broadly speaking, applicable to CNG storage tank assemblies of any size, both small and large capacity. The large capacity tank concept complements this system in the preferred embodiment, but it is not required.

In connection with the above, the configuration of the gaseous fuel storage tanks 16 is another important aspect of the present invention. In the preferred embodiment, each tank 16 is a large capacity tank, capable of storing a large quantity of gaseous fuel, in contrast to known small-volume tanks. Where the gaseous fuel is compressed natural gas, stored at approximately 70° F. and 3,600 psi, each tank 16 has a storage capacity large enough fill 500-700 compatible vehicles with CNG. Moreover, each storage tank is specially designed to withstand the pressures of the gaseous fuel inside the tank 16 and to insulate the gaseous fuel inside the tank from outside, ambient air, while having a lower weight profile than has heretofore been known.

Figure 2:
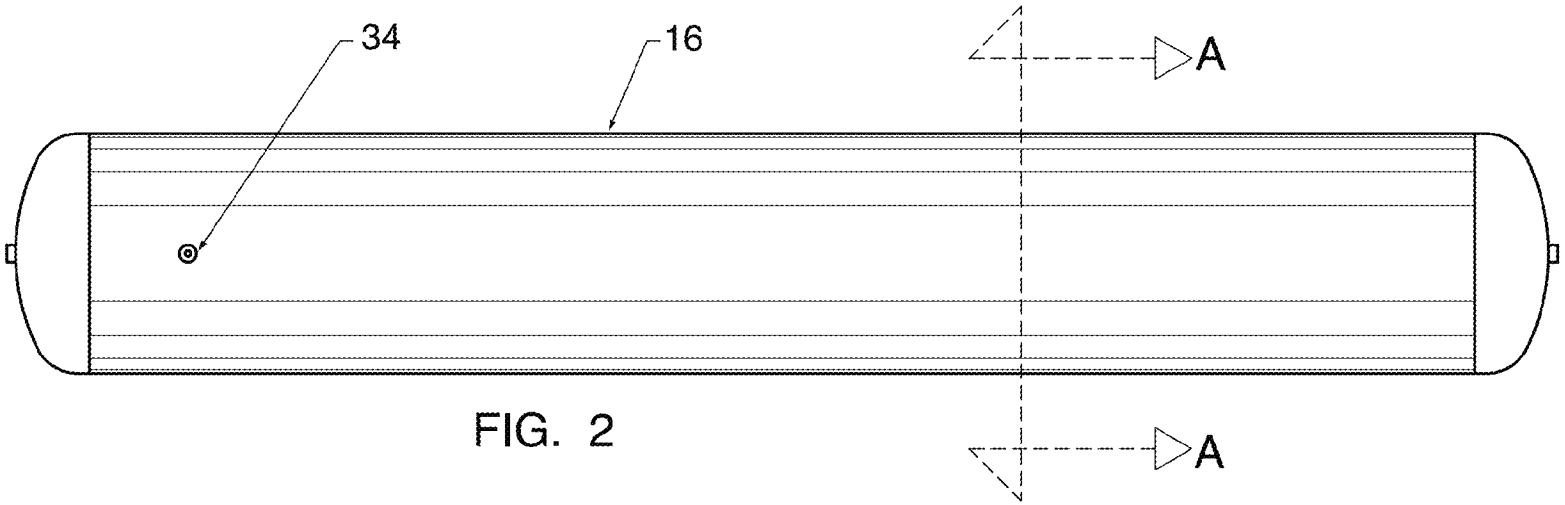
FIG. 2 is a side elevational view of a gaseous fuel storage tank for use with the system of FIG. 1.
Figure 3:
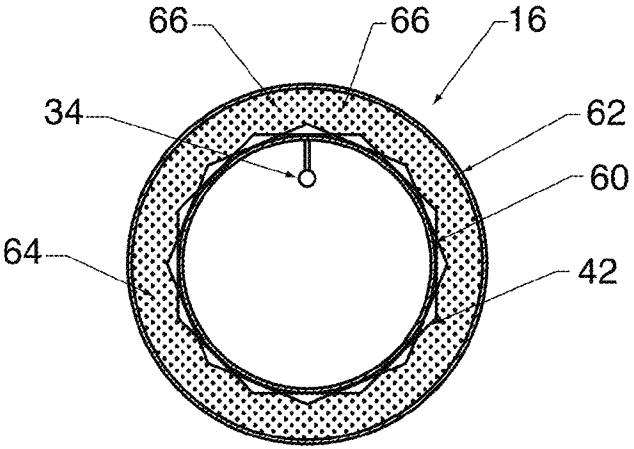
FIG. 3 is a cross-sectional view of the gaseous fuel storage tank for use in connection with the system of FIG. 1, taken along line A-A of FIG. 2.

FIGS. 2 and 3 show the configuration of a large-capacity storage tank 16. As shown therein, each tank 16 is generally cylindrical in cross-section and includes an inner tank wall 60 and an outer tank wall 62 defining an annular space 64 therebetween, the inner and outer walls 60,62 being generally concentric. Within the annular space 64, the auxiliary electric heater 42 is preferably disposed. The auxiliary electric heater 42 comprises a fiber carbon or metal electric mesh, through which electrical current is provided to produce heat. The mesh auxiliary heater 42 is preferably wrapped around the outer peripheral surface of the inner wall 60 of the tank 16 and preferably extends the length of the inner wall 60.

As further shown therein, a polymer based resin 66 fills the remainder of the annular space 64. Importantly, this resin 66 functions as an insulation layer to insulate the interior of the tank from the outside, ambient air (and potential low temperature thereof), as well as functioning as a mechanical reinforcement layer that effectively bonds the inner wall 60 to the outer wall 62, and as a shock absorber for absorbing stress on the walls of the inner wall 60. In this manner, the inner wall 60 and outer wall 62 are essentially joined together as a single unit. As will be readily appreciated, this increases the ability of the tank 16 to withstand the high pressures of gaseous fuel stored therein, as discussed below. In addition, the use of two walls bonded together with a polymer resin 66 decreases the weight of the tank 16 as compared to a single-walled tank of equal volume.

In the preferred embodiment, each wall is manufactured from steel, although other metals or materials known in the art may also be used without departing from the broader aspects of the present invention. Preferably, the walls of each wall 60,62 are approximately 1" thick in embodiments where steel is utilized. In contrast to the present invention, known single-wall storage tanks not having the structure of the tanks 16 shown in FIGS. 2 and 3 would have to be manufactured with walls that are 3" thick to safely withstand the pressures, approximately 3,600 psi, inside the tank. As will be readily appreciated, providing a tank with inch-thick walls is advantageous because the tanks can be manufactured by rolling, whereas a tank with 3" thick walls cannot be rolled using known methods and devices, but instead must be cast and, of course, would exhibit a much higher weight profile.

Through testing, it has been shown that the greatest stresses in cylindrical storage tanks oriented in the horizontal direction are concentrated along the top of the tank. Advantageously, as discussed above, the polymer based resin 66 disposed in the annular space 64 functions as a shock absorber to absorb the stresses upon the inner wall 60 of the tank, such that the outer wall 62 is subject to little stress, thereby allowing the walls 60,62 to be manufactured from steel or other metals of a lesser thickness. As compared to a single-walled storage tank having the same capacity and suitable to withstand gaseous fuel at a pressure of 3,600 psi at 70° F., the tank 16 of the present invention provides for an approximately 50% reduction in weight. In addition, significant weight savings are also realized in comparison to utilizing a large number of smaller storage tanks to store the same volume of gas, as more tanks equate more weight.

Figure 4:
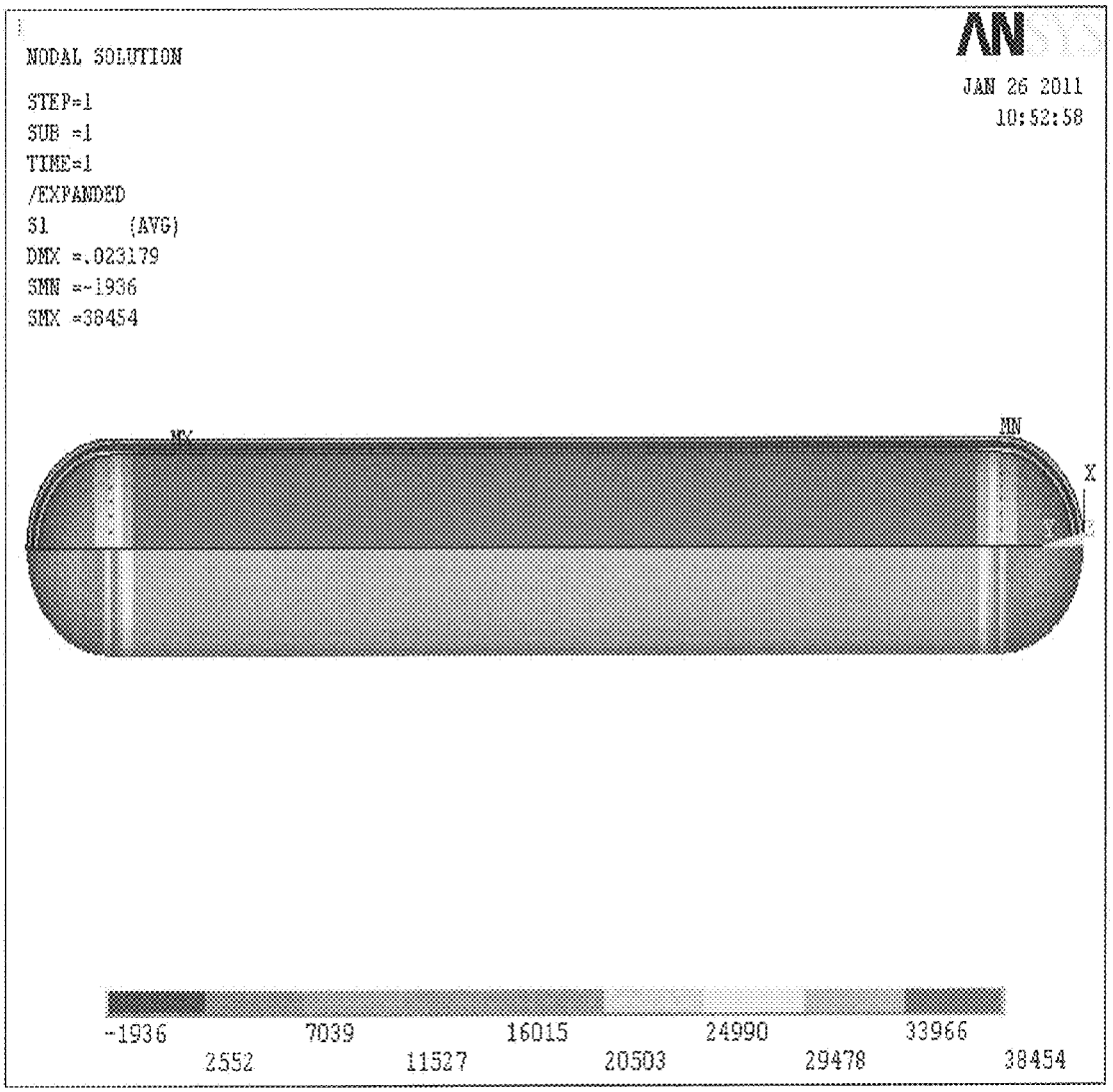
FIG. 4 is a diagram illustrating the stresses in the walls of the storage tank of FIG. 2 at an internal pressure of 3,600 psi.

Referring now to FIG. 4, a finite element analysis evidences the advantages provided by the large capacity, double-walled tank of the present invention. In particular, as shown in FIG. 3, at 3,600 psi, the large capacity of the tank 16 of the present invention, having a 40" diameter inner chamber defined by an inner wall 60 that is 1" thick, a 44" diameter outer chamber defined by an outer wall 62 that is 1" thick, and a 1" thick resin 66 disposed in the annular space 64 between the walls 60,62 results in a maximum von mises stress of 38,454 psi in the top of the inner wall 60, within material limits (see top half of tank in FIG. 4). In addition, the outer wall (bottom half of tank in FIG. 4) exhibits a stress of 33,966 psi, also within material limits. The weight of the tank having these parameters is approximately 10 tons.

Figure 5:
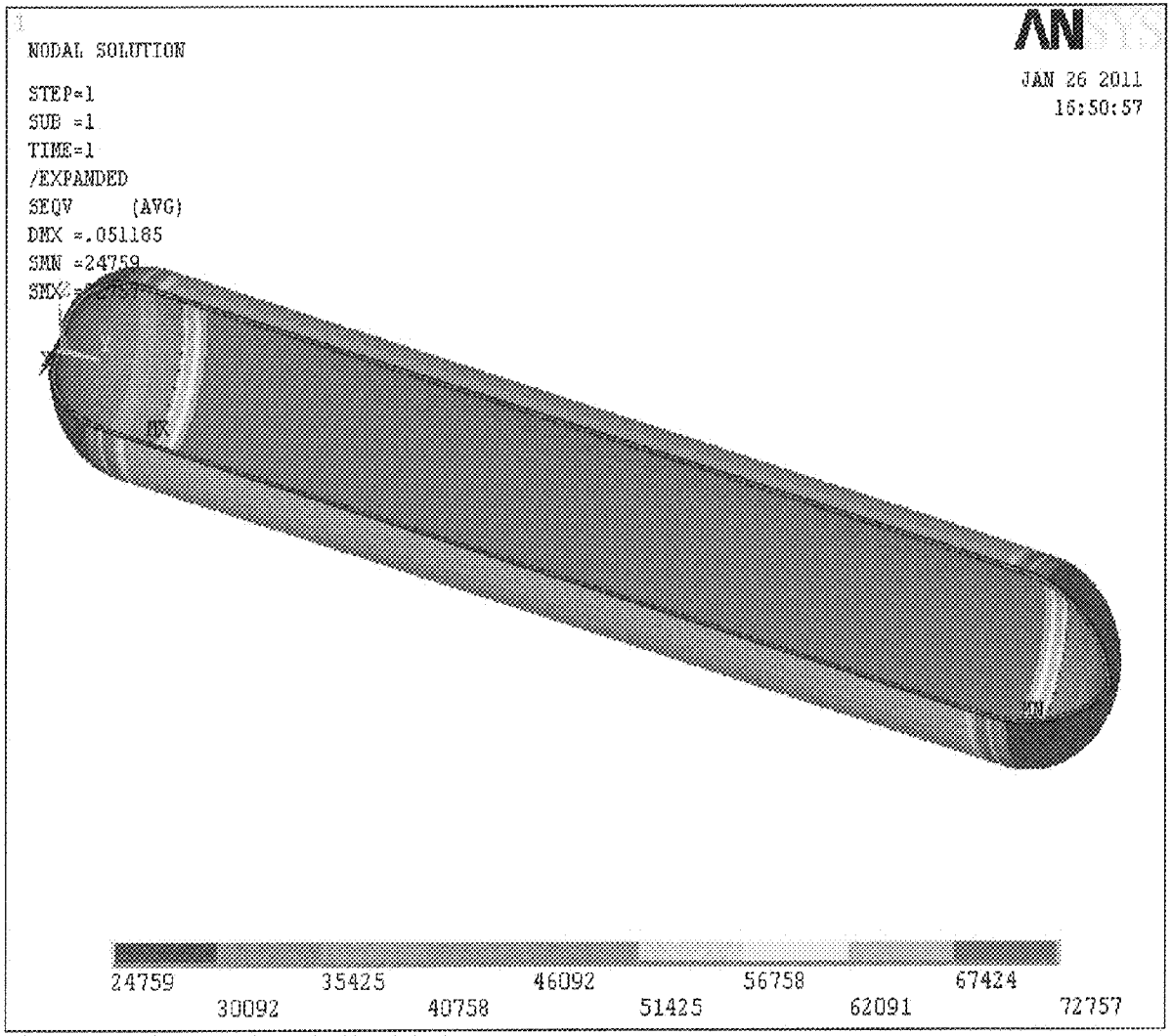
FIG. 5 is a diagram illustrating the stresses in the wall of a single-walled storage tank at an internal pressure of 3,600 psi.

In contrast, finite element analysis of a single walled tank having a 44" diameter and a 1" thick wall has shown that the tank would yield to internal pressures prior to reaching the optimum internal pressure of 3,600 psi. As shown in FIG. 5, the von mises stress is 72,757 psi in the sidewall, well above material limits. Accordingly, in order to withstand pressurization at 3,600 psi, the walls of a single walled tank having a 44" diameter would need to be 3" thick, as discussed above, which would translate to a gross tank weight of approximately 15 tons. As will be readily appreciated, in these examples, the double-walled tank 16 of the present invention allows for a weight savings of 5 tons over a single-walled tank. In addition to the weight savings, in contrast to the 3" thick single-wall tank, the tank 16 of the present invention can be rolled, rather than cast, thereby decreasing manufacturing time and cost.

It is therefore another important aspect of the present invention that the gaseous fuel storage tank 16 of the system of the present invention is capable of withstanding much higher pressures than known single-walled tanks of similar wall thickness. As a result, significant savings in weight, materials, cost, and ease of manufacture are realized, as discussed above. In view of the above, the present invention therefore provides a much lighter tank with the added ability to more precisely control the temperature of pressurized gaseous fuel stored within the tank. Indeed, by utilizing the compression of source gas to maintain the temperature within the storage tanks, significantly less energy is expended than would be the case if a stand-alone heater were utilized. Importantly, the temperature sensor and thermostat allow the temperature within the tanks to be more precisely controlled. Moreover, when the tanks are full and no compression is needed to fill the tanks, the temperature sensor and thermostat are arranged so as to control the auxiliary electric heater located in the main body of the tank to further maintain an optimum temperature of the CNG stored therein.

As discussed in detail above, the system 10 of the present invention utilizes the heat generated by gaseous compression of the fuel as a way to maintain the proper temperature and pressure regiment within the CNG storage tanks. In addition, the present invention provides a novel construction for large capacity CNG storage tanks that can be manufactured economically and at a much reduced weight profile. It will therefore be readily appreciated that a combination of the system 10 shown in FIG. 1, with the large capacity tanks 16 shown in FIGS. 2 and 3, results in a compressed gaseous fuel dispensing assembly that is more economical and efficient than has heretofore been known in the art.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A system for the cold-weather storage of gaseous fuels, comprising:

a gas source having an inlet pressure;

a slow-fill compressor having an inlet and an outlet, said inlet selectively communicating with said gas source and said outlet having a discharge pressure greater than said inlet pressure;

a heat exchange apparatus having an inlet and an outlet, said inlet selectively communicating with said compressor so as to receive pressurized gas therefrom;

a high-pressure storage tank having an inlet and an outlet, said inlet selectively communicating with said compressor so as to receive pressurized gas therefrom, said storage tank having a temperature sensor inside said storage tank for detecting a temperature of said pressurized gas inside said storage tank;

a fast-fill fuel dispenser in fluid communication with said outlet of said storage tank so as to receive said pressurized gas therefrom, said fuel dispenser selectively distributing said pressurized gas to compatible vehicles; and a valve assembly positioned downstream from said compressor and in fluid communication with said compressor outlet, said valve assembly selectively and alternatively directing said pressurized gas received from said compressor outlet to one of said heat exchange apparatus and said high-pressure storage tank in dependence upon said temperature of said pressurized gas within said storage tank;

wherein the temperature sensor is in electrical communication with said valve assembly and is configured to send a signal to said valve assembly to change a direction of said pressurized gas when said detected temperature inside said storage tank reaches a predetermined temperature; and wherein said heat exchange apparatus cools said pressurized gas received from said compressor prior to distribution to said storage tank.

2. The system for the cold-weather storage of gaseous fuels of claim 1, wherein:

said gas source is a gas main.

3. The system for the cold-weather storage of gaseous fuels of claim 1, wherein:

said gas source is low-pressure gas storage tank.

4. The system for the cold-weather storage of gaseous fuels of claim 1, wherein:

said gas is natural gas.

5. The system for the cold-weather storage of gaseous fuels of claim 1, wherein:

said pressurized gas is stored in said storage tank at approximately 3,600 psi.

6. The system for the cold-weather storage of gaseous fuels of claim 1, further comprising:

a manifold in fluid communication with said storage tank and said fuel dispenser so as to receive said pressurized gas from said storage tank and distribute said pressurized gas to said fuel dispenser.

7. The system for the cold-weather storage of gaseous fuels of claim 1, further comprising:

a plurality of valves that are controllable to selectively control a flow of gas through said system.

8. The system for the cold-weather storage of gaseous fuels of claim 1, wherein:

said valve assembly is a solenoid valve.

9. The system for the cold-weather storage of gaseous fuels of claim 1, wherein:

said storage tank includes an auxiliary heater, said auxiliary heater being selectively actuatable to heat said pressurized gas within said storage tank; and wherein said temperature sensor controls activity of said auxiliary heater in dependence upon said temperature within said storage tank.

10. The system for the cold-weather storage of gaseous fuels of claim 9, further comprising:

a power supply in electrical communication with said compressor and said auxiliary heater.

11. The system for the cold-weather storage of gaseous fuels of claim 9, wherein:

said storage tank has an inner wall and an outer wall, said inner wall and outer wall defining an annular space therebetween; and wherein said auxiliary heater is disposed about a periphery of said inner wall within said annular space.

12. The system for the cold-weather storage of gaseous fuels of claim 11, further comprising:

a polymer-based resin disposed in said annular space.

13. The system for the cold weather storage of gaseous fuels of claim 1, wherein:

said storage tank is formed by rolling.

14. A system for the cold-weather storage of gaseous fuels, said system comprising:

a gas source having an inlet pressure;

a slow-fill compressor having an inlet and an outlet, said inlet selectively communicating with said gas source and said outlet having a discharge pressure greater than said inlet pressure;

a heat exchange apparatus having an inlet and an outlet, said inlet selectively communicating with said compressor so as to receive pressurized gas therefrom, said heat exchanger cooling said pressurized gas;

a high-pressure storage tank having an inlet and an outlet, said inlet selectively communicating with said compressor so as to receive pressurized gas therefrom;

a valve assembly located downstream from said compressor outlet and in fluid communication with said compressor outlet, said valve assembly selectively directing said pressurized gas received from said compressor outlet to said heat exchange apparatus to cool said pressurized gas prior to entering said high-pressure storage tank or directly to said high-pressure storage tank in dependence upon a temperature within said storage tank; and a temperature sensor and thermostat in communication with an interior of said storage tank, said thermostat being in electrical communication with a solenoid valve and being set to maintain a predetermined temperature within said storage tank;

wherein said thermostat sends a signal to said solenoid valve to change a direction of said pressurized gas when said temperature inside said storage tank reaches said predetermined temperature.

* * * * *